US006588346B1

(12) United States Patent
Bockheim et al.

(10) Patent No.: US 6,588,346 B1
(45) Date of Patent: Jul. 8, 2003

(54) ARTICULATING TABLE

(75) Inventors: Robert J Bockheim, Grand Rapids, MI (US); Peggy M Brenner, Grand Rapids, MI (US); Scott G Corbat, Cedar Springs, MI (US); Kent L Ensing, Belmont, MI (US); Chris A Pike, Grand Rapids, MI (US); Tim O Schad, East Grand Rapids, MI (US); Lynda E Chesser, East Grand Rapids, MI (US); Bill F Schacht, East Grand Rapids, MI (US)

(73) Assignee: Nucraft Furniture Co., Comstock Park, MI (US)

( * ) Notice: Subject to any disclaimer, the term of this patent is extended or adjusted under 35 U.S.C. 154(b) by 0 days.

(21) Appl. No.: 09/571,524

(22) Filed: May 16, 2000

(Under 37 CFR 1.47)

(51) Int. Cl.[7] ..... A47B 37/00
(52) U.S. Cl. ..... 108/50.02; 108/59
(58) Field of Search ..... 108/50.02, 59, 108/64, 69, 83, 85, 88, 89, 66, 87; 248/188, 6, 166

(56) References Cited

U.S. PATENT DOCUMENTS

| | | | | |
|---|---|---|---|---|
| 3,955,850 | A | | 5/1976 | Toso |
| 4,069,771 | A | | 1/1978 | Bertelsen |
| 4,114,541 | A | | 9/1978 | Weddendorf |
| 4,148,264 | A | * | 4/1979 | Caravias |
| 4,223,613 | A | | 9/1980 | Yoshizawa |
| 4,237,796 | A | | 12/1980 | Gordon et al. |
| 4,748,913 | A | * | 6/1988 | Favaretto et al. |
| 4,922,835 | A | | 5/1990 | Van Vliet et al. |
| 5,193,465 | A | | 3/1993 | Delaye et al. |
| 5,237,937 | A | * | 8/1993 | Peltier et al. |
| 5,261,735 | A | | 11/1993 | Cohen et al. |
| 5,277,130 | A | | 1/1994 | Caporrela |
| 5,438,937 | A | | 8/1995 | Ball et al. |
| 5,522,324 | A | * | 6/1996 | Van Gelder et al. |
| 5,655,822 | A | | 8/1997 | Roberts et al. |
| 5,676,068 | A | | 10/1997 | Kallander |
| 5,842,425 | A | | 12/1998 | Van der Aa |
| 5,988,076 | A | * | 11/1999 | Vander Park |
| 6,003,447 | A | * | 12/1999 | Cox et al. |

FOREIGN PATENT DOCUMENTS

| | | |
|---|---|---|
| AT | 75310 | 9/1917 |
| CN | 5146316 | 6/1993 |
| DE | 2545160 | 4/1977 |
| DE | 3920265 | 1/1991 |

OTHER PUBLICATIONS

Davis Zoom Furniture Advertising Brochure.

* cited by examiner

*Primary Examiner*—Jose V. Chen
(74) *Attorney, Agent, or Firm*—Van Dyke, Gardner, Linn & Burkhart, LLP

(57) ABSTRACT

An articulating table comprises a pedestal, a pivot, and a table top having first and second top portions. The top portions are connected with the pedestal by the pivot for horizontal pivotal movement between open and closed positions relative to each other. The top portions are substantially juxtaposed in the closed position and are separated in a V-shape in the open position. A light supporting spine extends between the top portions. Conduit channels mounted at inner edges of the top portions provide electrical, optical, pneumatic, or hydraulic service to terminals positioned along the inner edges of the top portions. The channels can have openable top and rear access covers. A conduit channel also can extend through at least a portion of the spine. Fixed position table tops can be positioned on the pedestal at either or both ends of the articulating top portions.

25 Claims, 16 Drawing Sheets

ARTICULATING TABLE

CROSS-REFERENCES TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention relates to tables and more particularly to conference tables and the like. In the course of carrying on interpersonal relationships and more particularly pursuing business relationships, people will gather from time to time in groups about a table. Meeting or conference tables are well known, and generally provide two essential functions of meeting. First, tables are a work surface. Portable tangible items are shared upon a table. Notes and agreements and other documents are written upon a table. Second, tables define a gathering place, a place for dialog. The inherent social geometry of a table requires face-to-face interpersonal exchange. People who gather at a table will typically sit about a perimeter of the table and will generally face one another because they are directed toward a generally central, common focus that is defined by the inherent geometry of gathering about a table.

Further as to gathering at a conference table, the exchange of information has traditionally been initiated with a status report of sorts that sets the stage and draws attention to an individual who makes the report. More and more commonly, conference table gatherings include a visual display. More specifically with the development of technology, in particular computer technology, multimedia presentations are often used to enhance the presentation and sharing of concepts or ideas and information generally. Such visual presentations are typically presented at a singular display that is located apart from and outside the perimeter of a table gathering, which is in direct conflict with the geometry of gathering at a table. That is, the geometry of gathering at a table naturally directs the participants toward one another. The use of a media display outside the perimeter of the table diverts at least some of the participants away from the group, they will turn from the table to the display. Others of the group can be socially isolated from the group because they cannot see the display, which is behind them. Alternatively, one's view of the display may be blocked by other participants. Further, one may be required to turn away from the gathering to the display, separating them by turning their back to the group.

Thus, one will understand a desire to create a gathering or conferencing setting in which the established utilitarian benefits and social enhancements of a conference table are combined with the communication benefits of using a multimedia presentation.

BRIEF SUMMARY OF THE INVENTION

Accordingly, an articulating table of the invention is configurable between a closed position in which the traditional established utilitarian and social benefits of a conference table are provided and an open position in which the communication benefits of using a multimedia presentation are united with the traditional benefits of meeting at a conference table. More specifically, the invention has a pedestal, a pivot, and a table top. The table top further has first and second top portions. The first top portion is connected with the pedestal, while the second top portion is connected with the pivot. Thus, the second top portion pivots between open and closed positions relative to the first top portion.

In one aspect of the invention, the first and second portions are juxtaposed in the closed position, defining a unitary work surface, and are separated in the open position, defining distinct work surfaces. In another aspect, the invention includes a spine that is connected with the pedestal and extends away from the pedestal, generally between the first and second top portions. An articulating table of the invention may also include a conduit that extends to a terminal end, with a connector at the terminal end. The conduit and connector may provide a connection that is one of an electrical, optical, pneumatic, and hydraulic connection. The connector may also be located at one of the first and second top portions. Further, the conduit may extend through at least a portion of the spine, with the connector located at the spine.

An articulating table of the invention may also have a second pedestal that is connected with the first pedestal. The second pedestal may further include a second table top.

These and other features, objects, and benefits of the invention will be recognized by one having ordinary skill in the art and by those who practice the invention, from the specification, the claims, and the drawing figures.

DETAILED DESCRIPTION OF THE INVENTION

Figure 1:
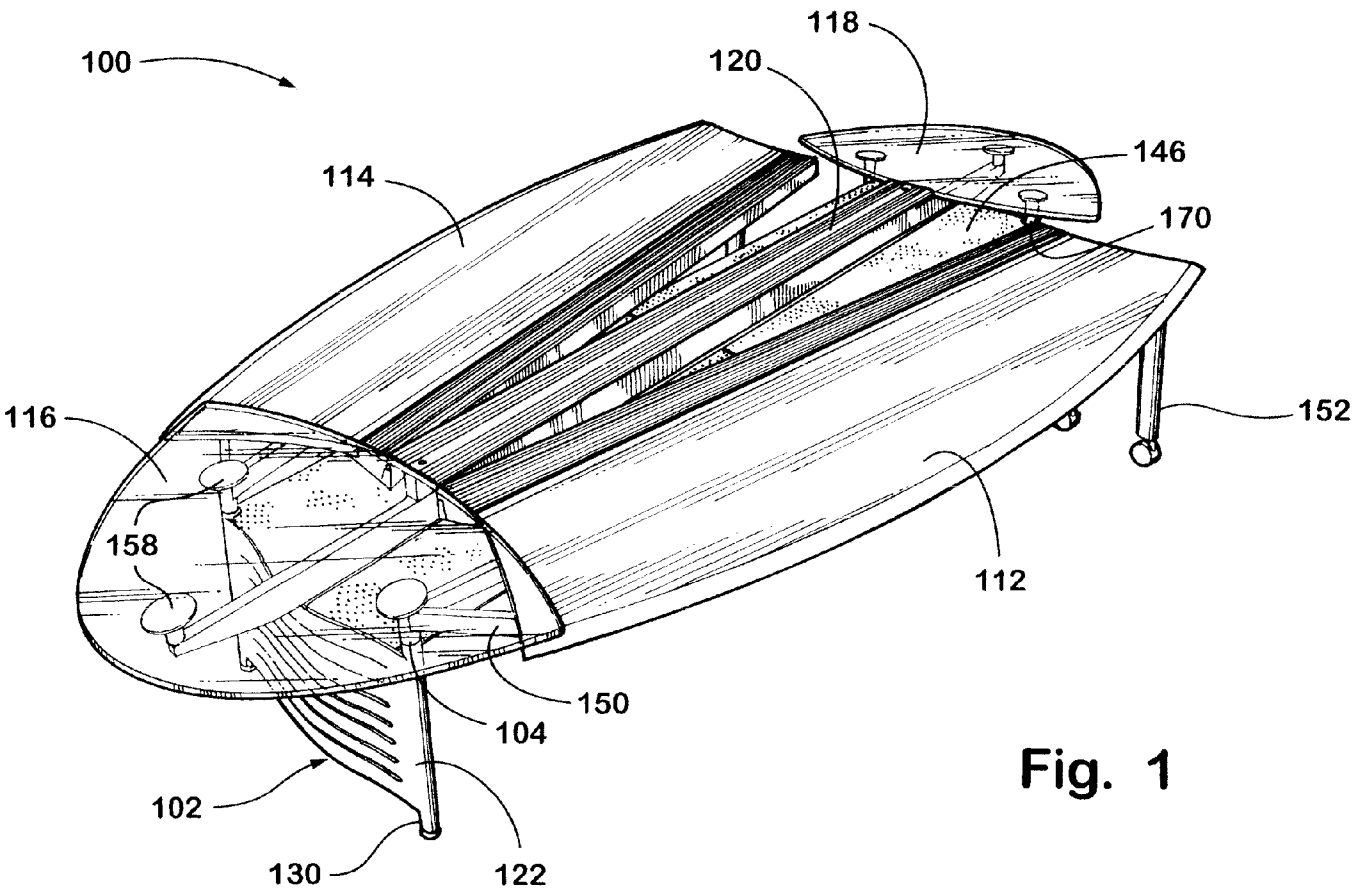
FIG. 1 is an end perspective view of an articulating table according to the invention with transparent end table portions, showing the table in an open position.
Figure 2:
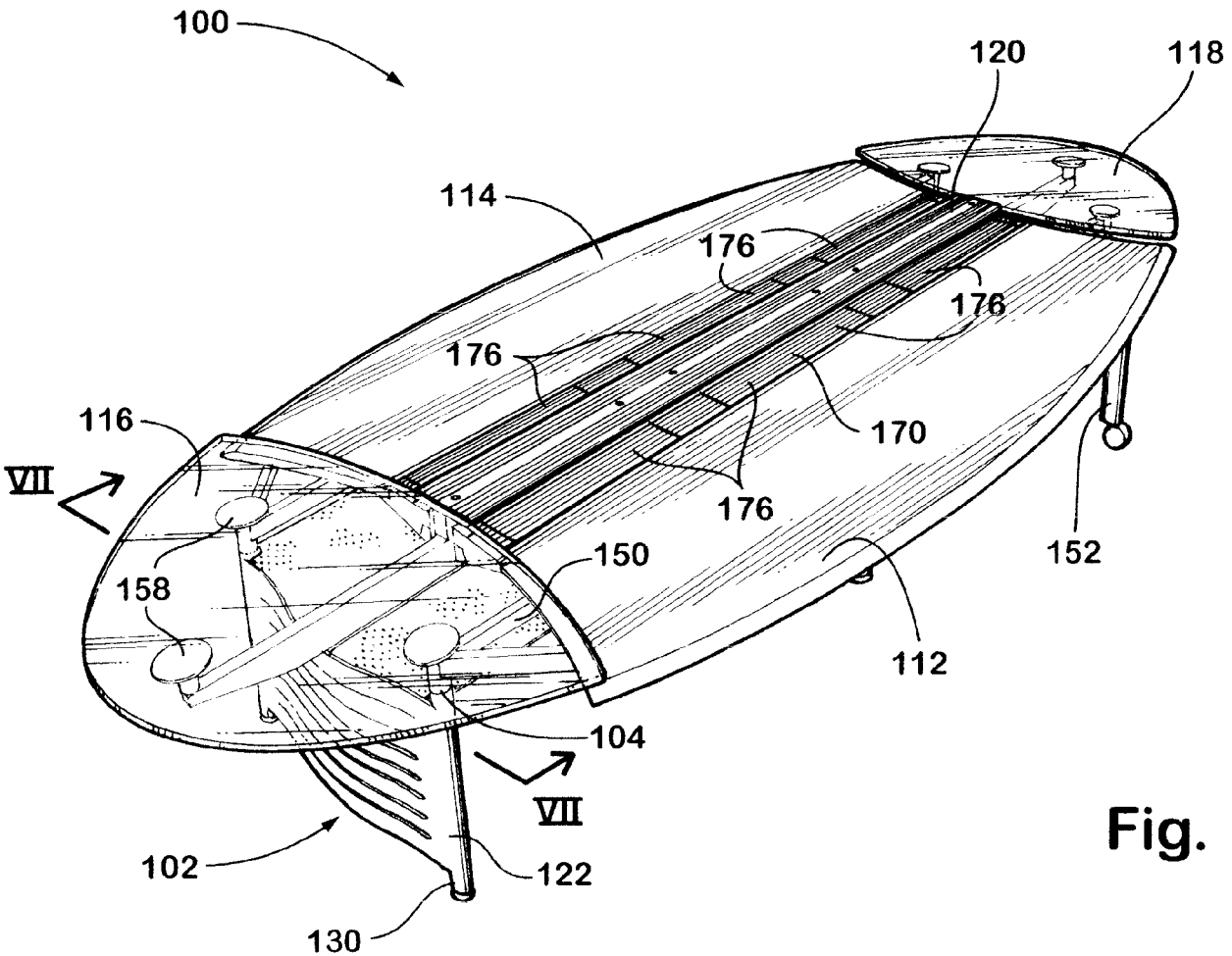
FIG. 2 is the view of FIG. 1, showing the table in a closed position.
Figure 3:
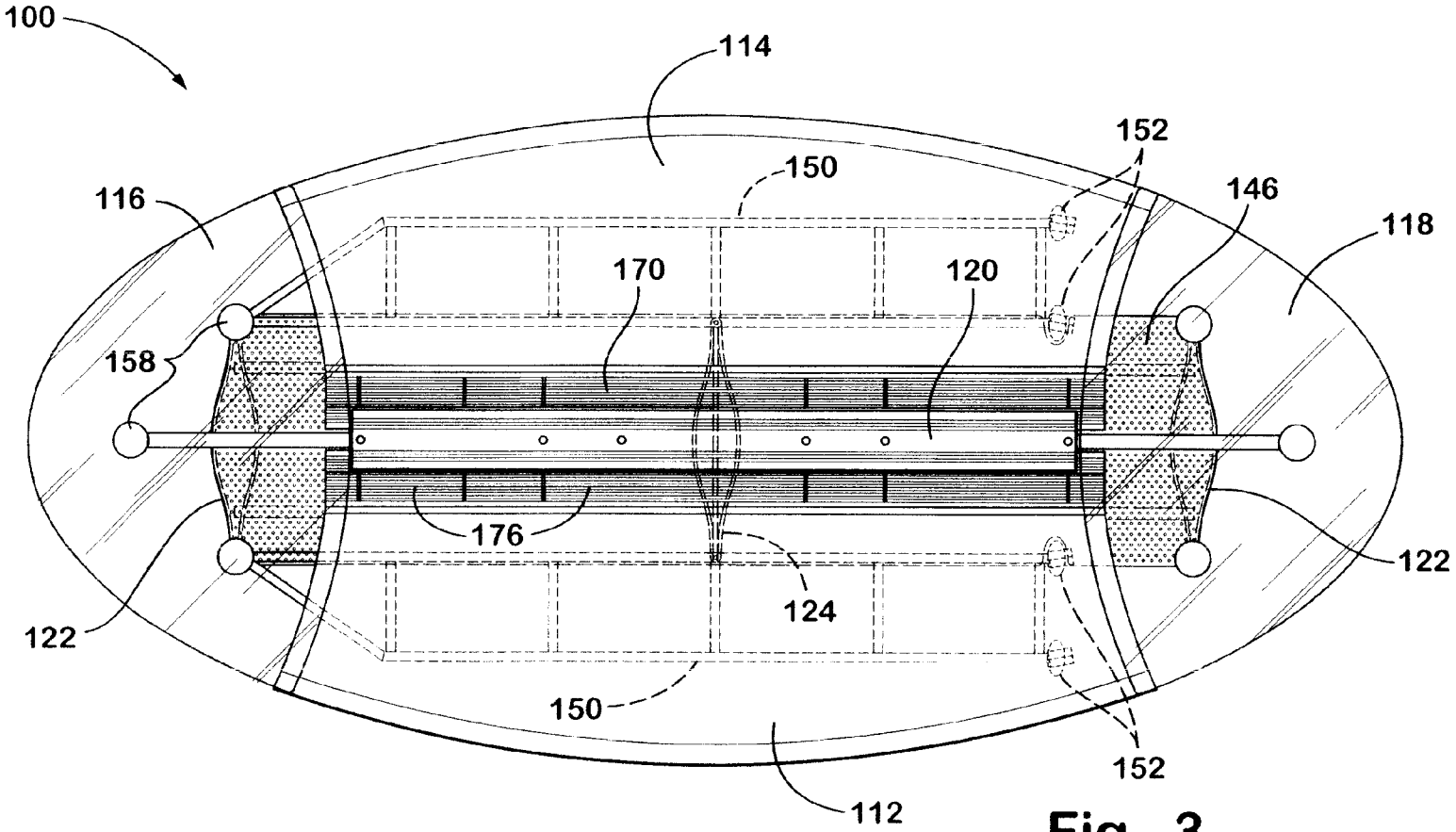
FIG. 3 is a top plan view thereof.
Figure 4:
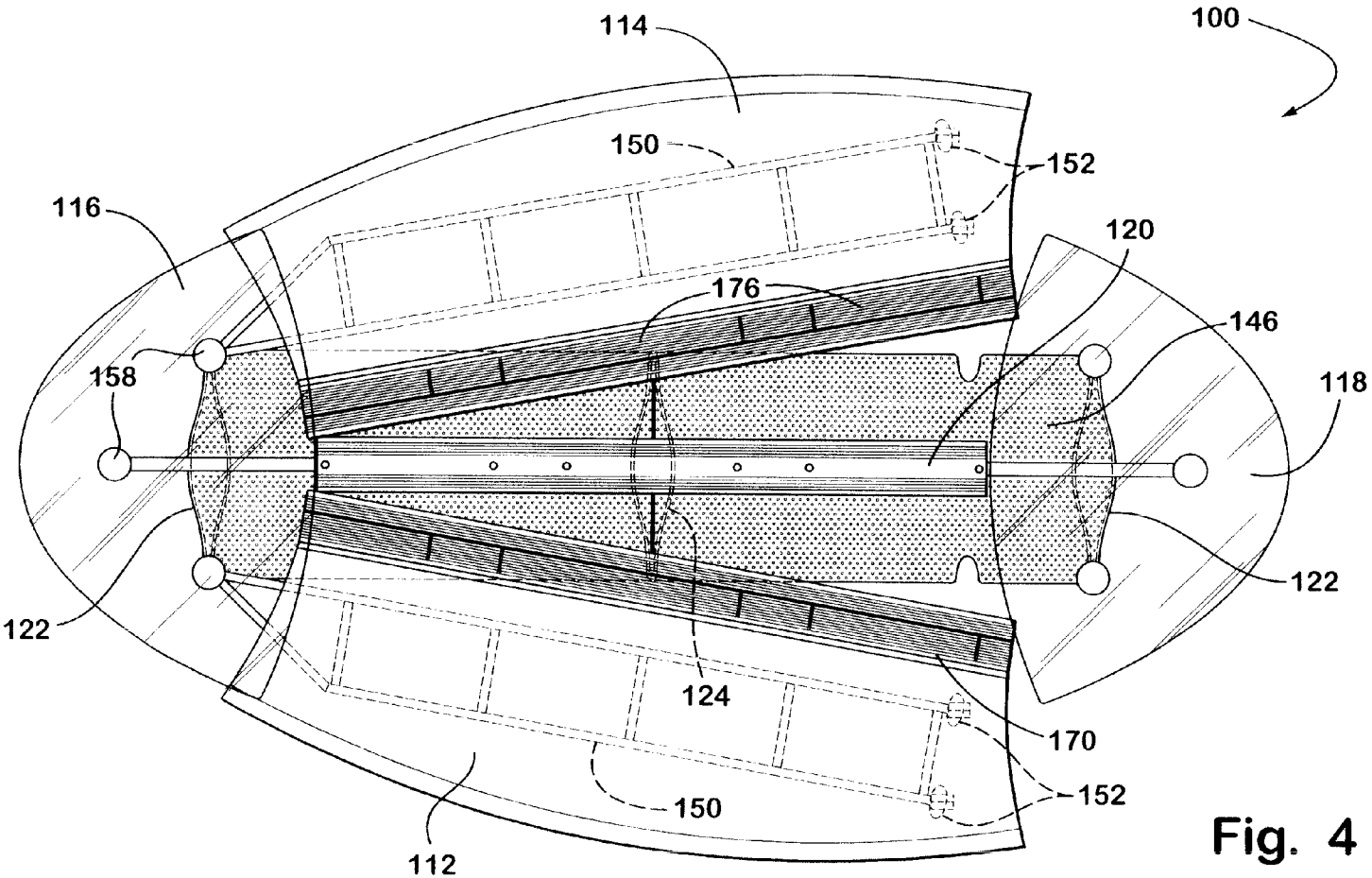
FIG. 4 is the view of FIG. 3 showing the table in the open position.

An articulating table 100 according to the invention is shown in the drawing figures and has a pedestal 102, a pivot 104, and a table top (FIGS. 1–4). The table top includes first and second top portions or wings 112 and 114. A preferred embodiment of the invention, namely, table 100, generally shown in the drawing figures, has an elongated oval shape with elevated second and third table tops 116 and 118, and a spine 120.

Figure 6:
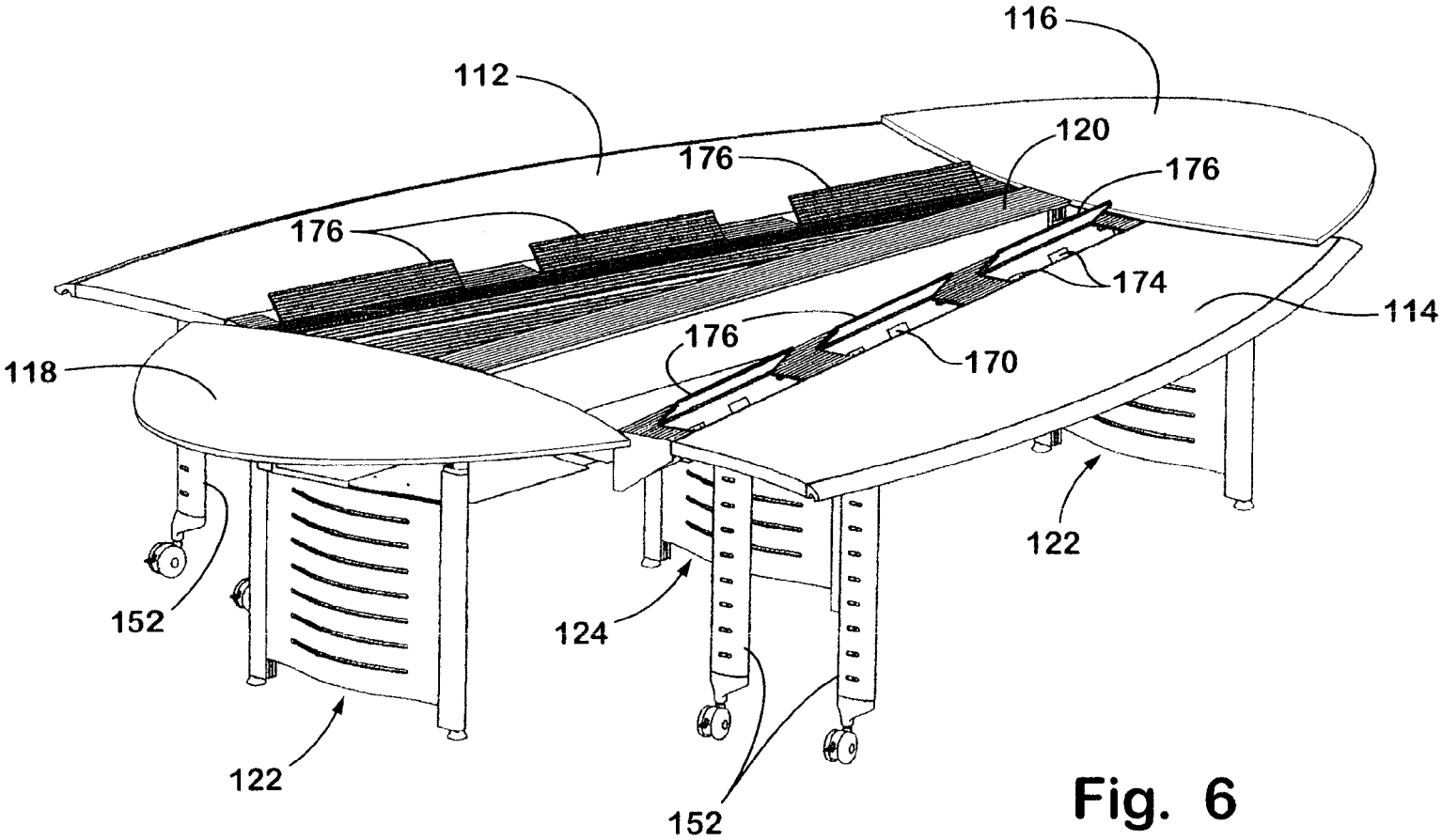
FIG. 6 is an end perspective view of a first alternative articulating table according to the invention with solid end table portions, showing the table in an open position.

One having ordinary skill in the art will understand that an articulating table of the invention may be constructed with alternative configurations, including and not limited to an articulating table without the second and third table tops 116 and 118, or with the wings 112 and 114 and the second table top 116 laying flush, generally in the same plane, for example. The second and third table tops 116 and 118 may be transparent or translucent panels as shown generally, or may be opaque as shown in drawing FIG. 6, as well as the wings 112 and 114. Further, the pedestal 102 may include a singular floor standing, even cantilevered, support of the wings 112 and 114 or a supporting sub-frame structure as is specifically shown in the drawing figures.

Figure 5:
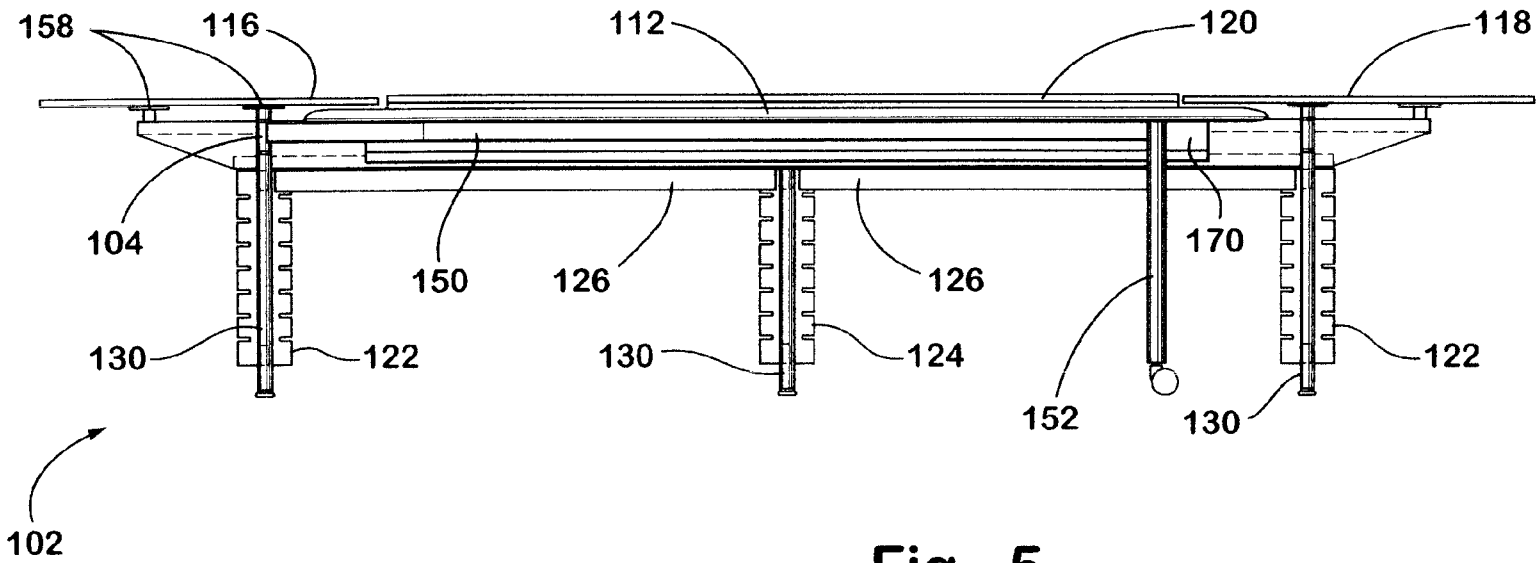
FIG. 5 is a side elevational view of the table in the closed position.
Figures 7, 9, 10, 11:
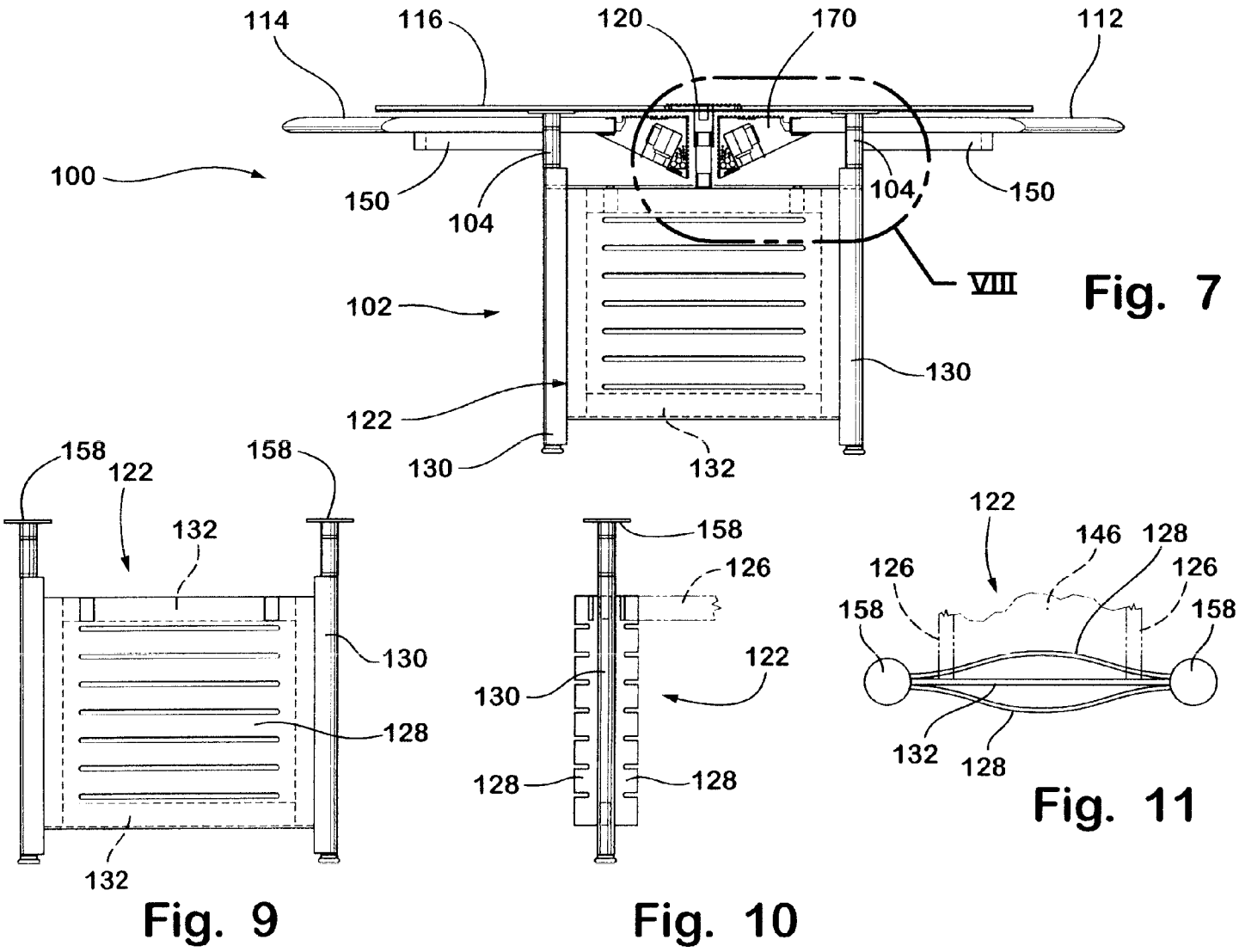
FIG. 7 is an end elevational view of the table in the closed position, as indicated by sight line VII—VII of FIG. 2.
FIG. 9 is an end elevational view of an end pedestal panel base of the articulating table.
FIG. 10 is a side elevational view thereof, showing a fragmentary portion of a sub-panel in phantom.
FIG. 11 is a top plan view thereof.

As shown, the pedestal 102 has opposing end panels 122 and a center panel 124 that are interconnected with the spine 120 and a pair of stretchers 126 (FIG. 5). One having ordinary skill in the art knows that the specific configuration and construction of the pedestal panels will be dictated by design aesthetics, task definition, and structural requirements according to the scale or size of the table desired. The articulating table 100 shown in the drawing figures is about 150 inches (3810 mm) in overall length, about 70 inches (1778 mm) in overall width, and about 30 inches (762 mm) tall. Each of the end and center pedestal panels 122 and 124 respectively, stands on two about 3.5 inches by 1.75 inch (89×44 mm) extruded aluminum legs 130 or the like (FIGS. 1–5). Upper and lower panel cross stretchers 132 that may be about 2.5 inch by 1 inch (64×25 mm) tubular steel members interconnect the legs 130 and form a generally rectangular pedestal panel frame (FIGS. 7–14). A decorative overlay or facade 128 may be applied to the pedestal panel frame, as shown (FIG. 11).

The pedestal panels 122 and 124 are interconnected with pairs of pedestal stretchers 126 (FIGS. 5, 8, 10, and 11). Each of the pedestal stretchers 126 may be an about 1.5 inch (38 mm) high and 1 inch (25 mm) wide rectangular steel member having a length of about 103.5 inches (2629 mm) according to the length of the table 100. Further, a decorative sub-panel 146 overlays the stretchers 126 and extends their length, generally between the end pedestal panels 122 (FIGS. 1, 3, 4, 8 and 18).

Figure 17:
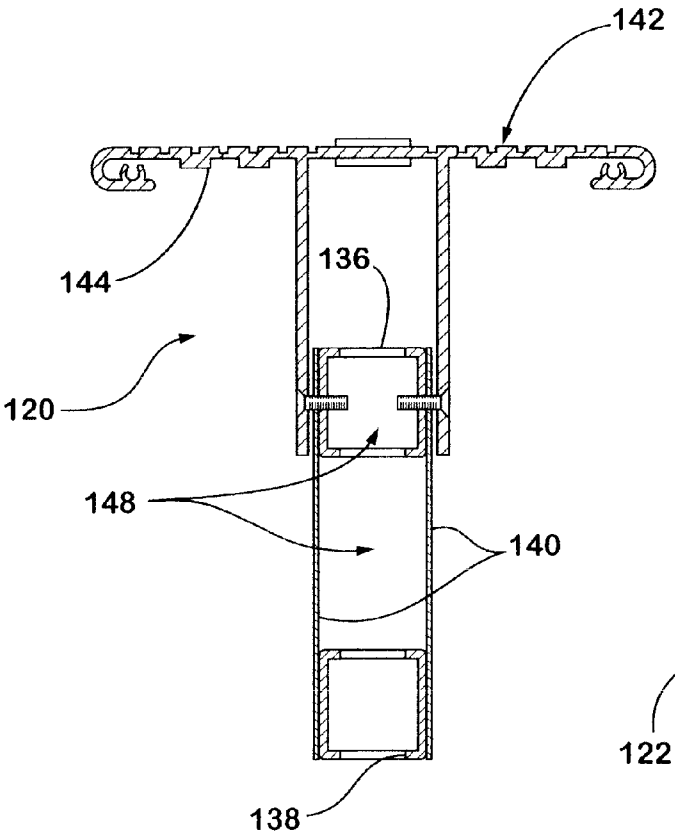
FIG. 17 is a cross-sectional view thereof, taken along line XVII—XVII of FIG. 15.

The generally T-shaped spine 120 is also shown to space and interconnect the pedestal panels 122 and 124 (FIGS. 1–8 and 15–17). The spine 120 has upper and lower chord members 136 and 138 respectively, comprising lengths of about 1.75 inch (44 mm) square tubular steel members. The upper and lower chord members 136 and 138 respectively, are spaced about 3 inches (76 mm) on center and are interconnected with panel members 140. The chord members 136 and 138 and the panels 140 may be structurally interconnected by any suitable method, including and not limited to the use of welding, rivets, adhesives, and screws. An extruded T-member 142 extends less than about 2 inches (51 mm) above the upper chord member to a top flange 144 of about 6.5 inches (165 mm) width. One having ordinary skill in the art will understand that the structure of the upper and lower chord members 136 and 138 respectively, may provide sufficient structure to the spine with the T-member being added for aesthetic reasons or to provide other features. One will also know that the spine 120 may be provided with or inherently have various passageways 148 that lend themselves to routing various conduits and the like (FIG. 17).

Figure 8:
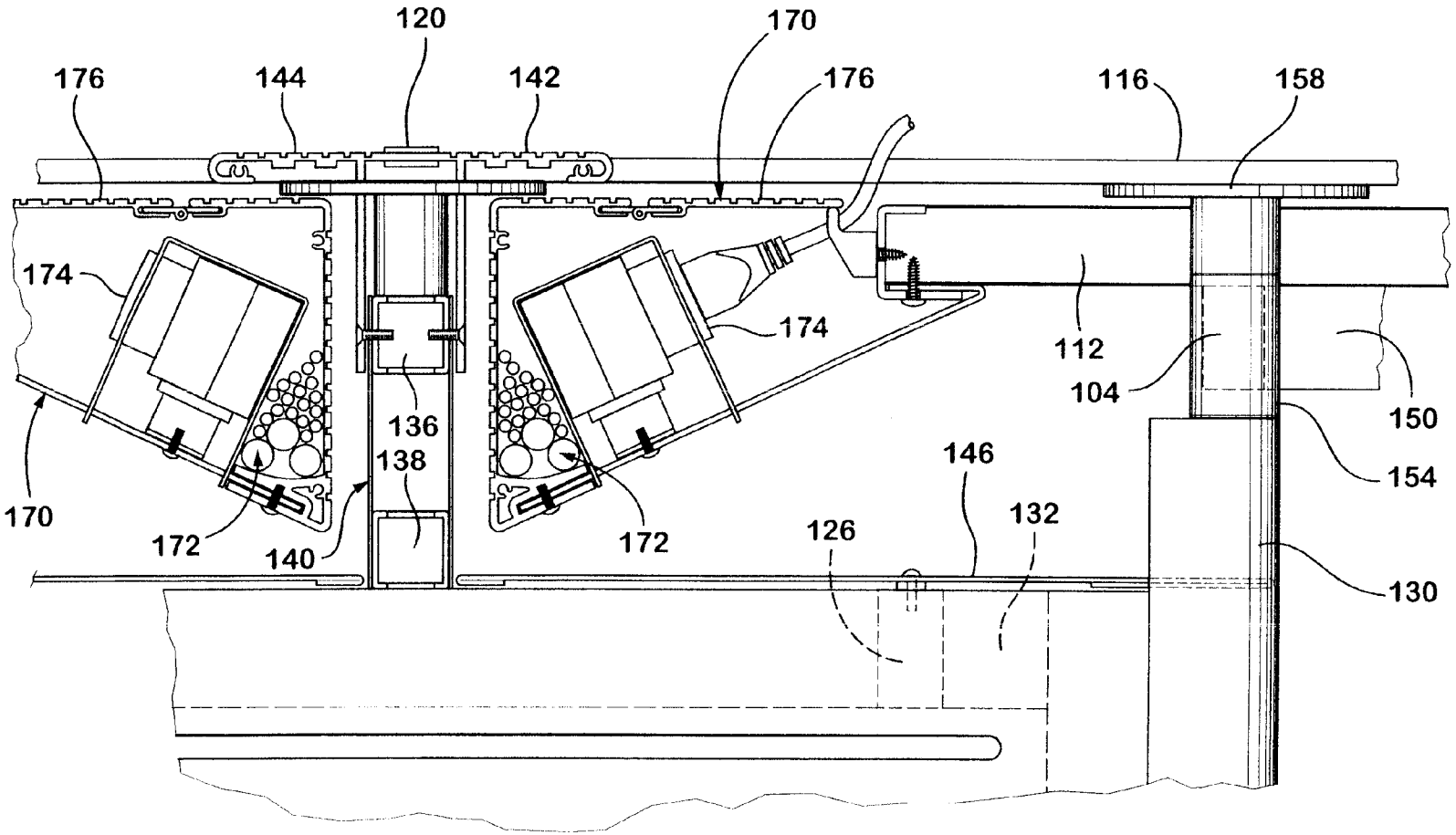
FIG. 8 is an enlarged fragmentary view of detail VIII of FIG. 7.
Figure 14:
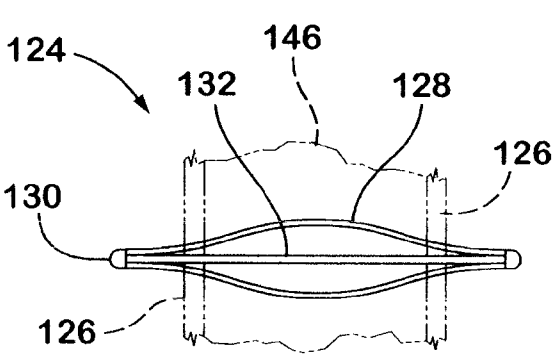
FIG. 14 is a top plan view thereof.
Figure 13:
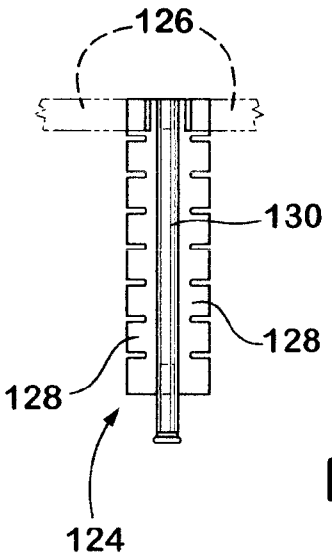
FIG. 13 is a side elevational view thereof, showing a fragmentary portion of the sub-panel in phantom.
Figure 12:
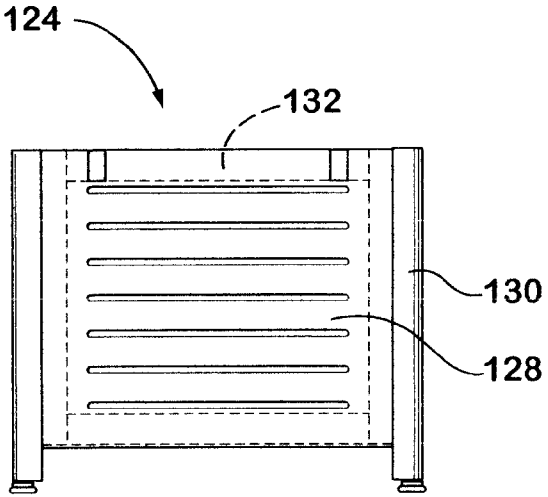
FIG. 12 is an end elevational view of a center pedestal panel base of the articulating table.
Figure 15:
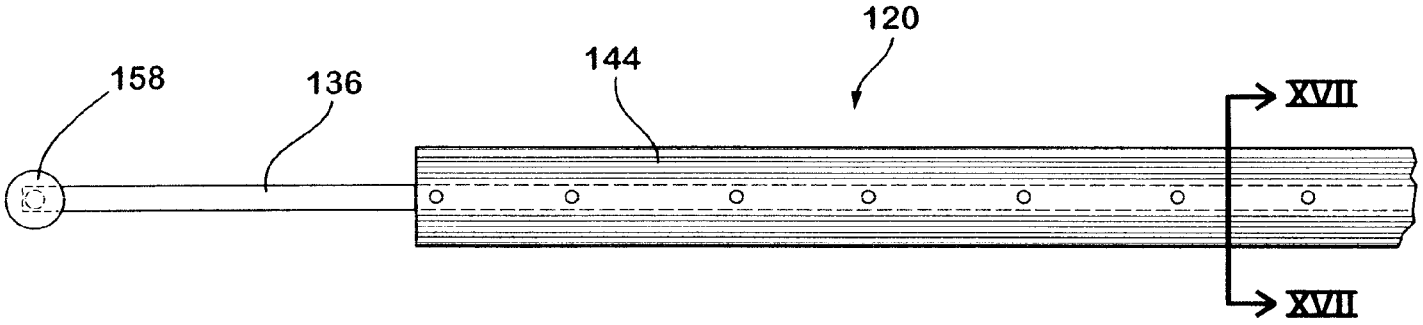
FIG. 15 is a fragmentary top plan view of one end of a center spine of the articulating table, the other end being a mirror image thereof.
Figure 16:
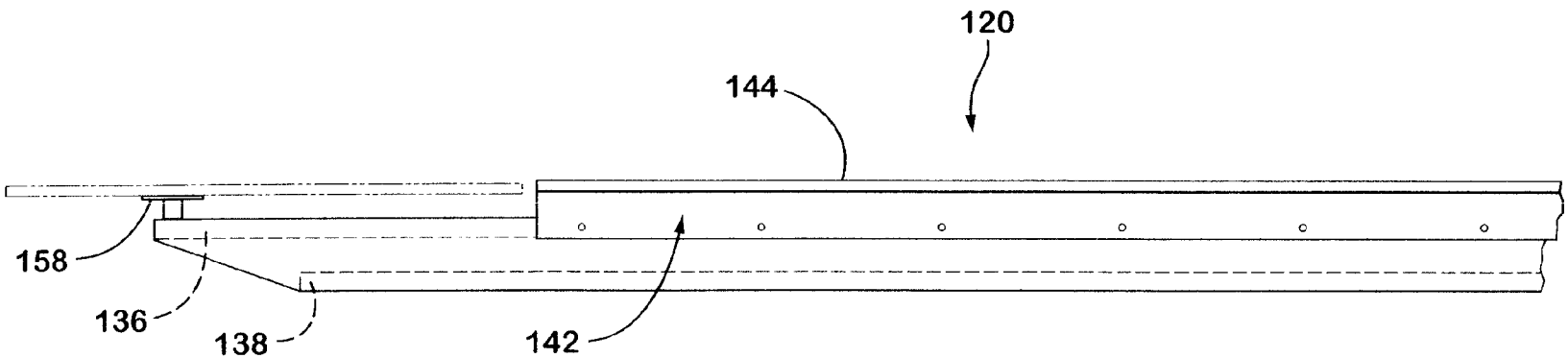
FIG. 16 is a side elevational view thereof.
Figure 18:
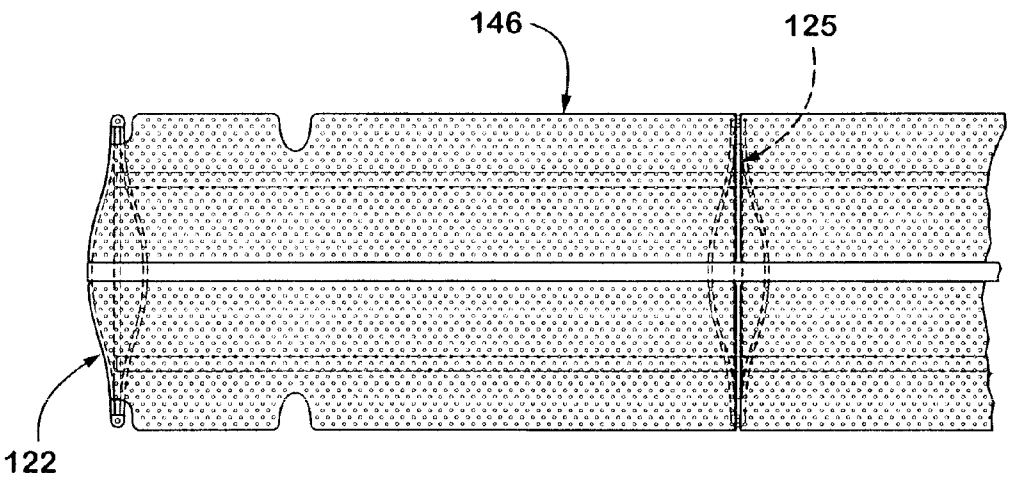
FIG. 18 is a fragmentary top plan view of one end of the sub-panel, the other end being a mirror image thereof.
Figure 22:
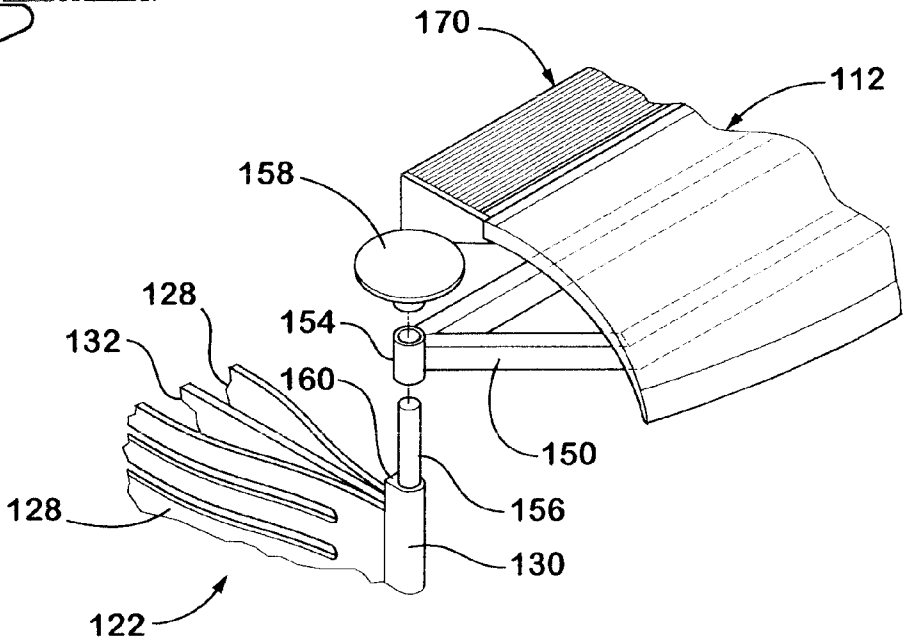
FIG. 22 is a fragmentary exploded perspective view of a pivot connection between a wing and an end panel of the table.
Figure 23:
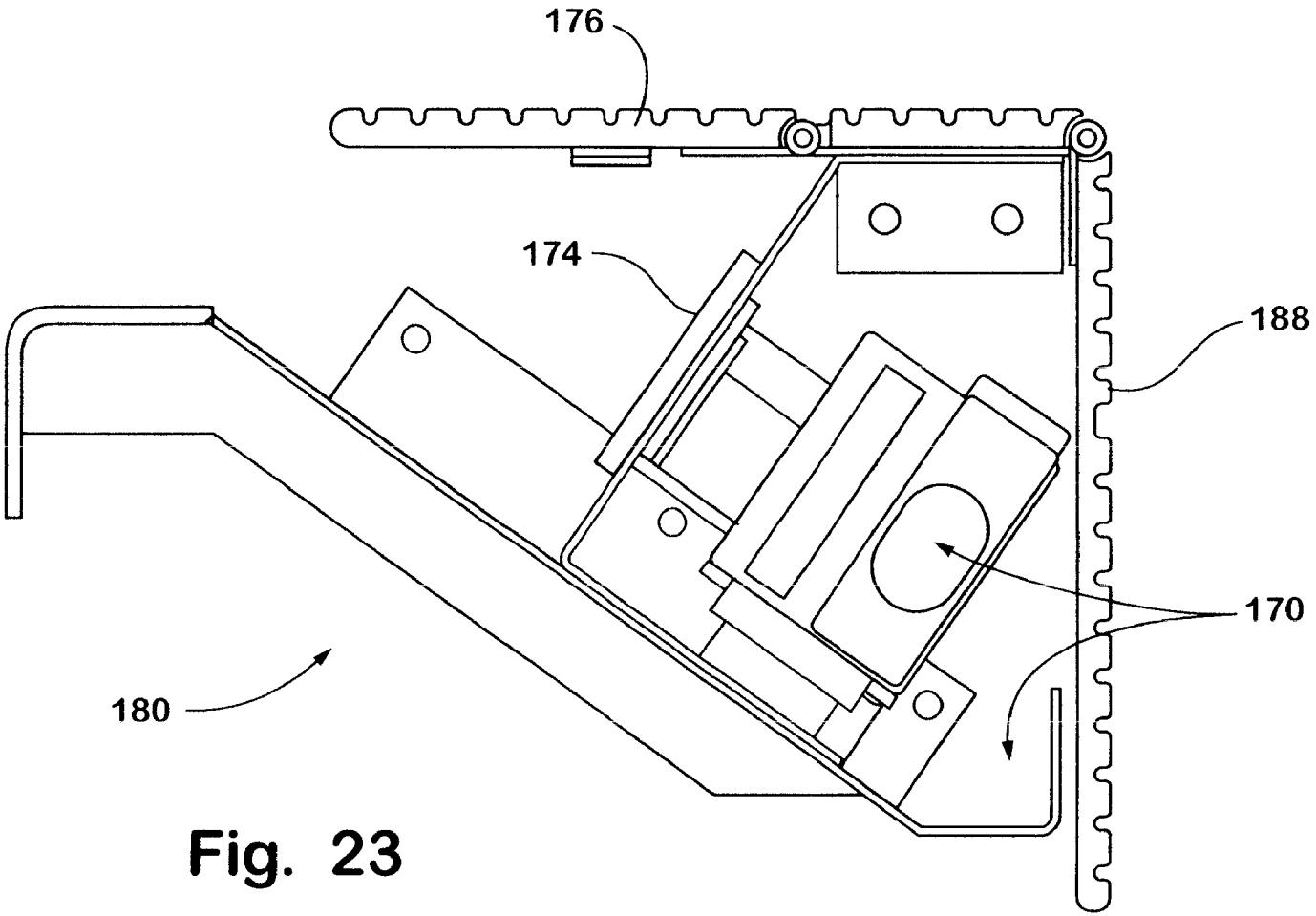
FIG. 23 is the view of FIG. 20 showing one of various alternative constructions of the conduit channel.
Figure 24:
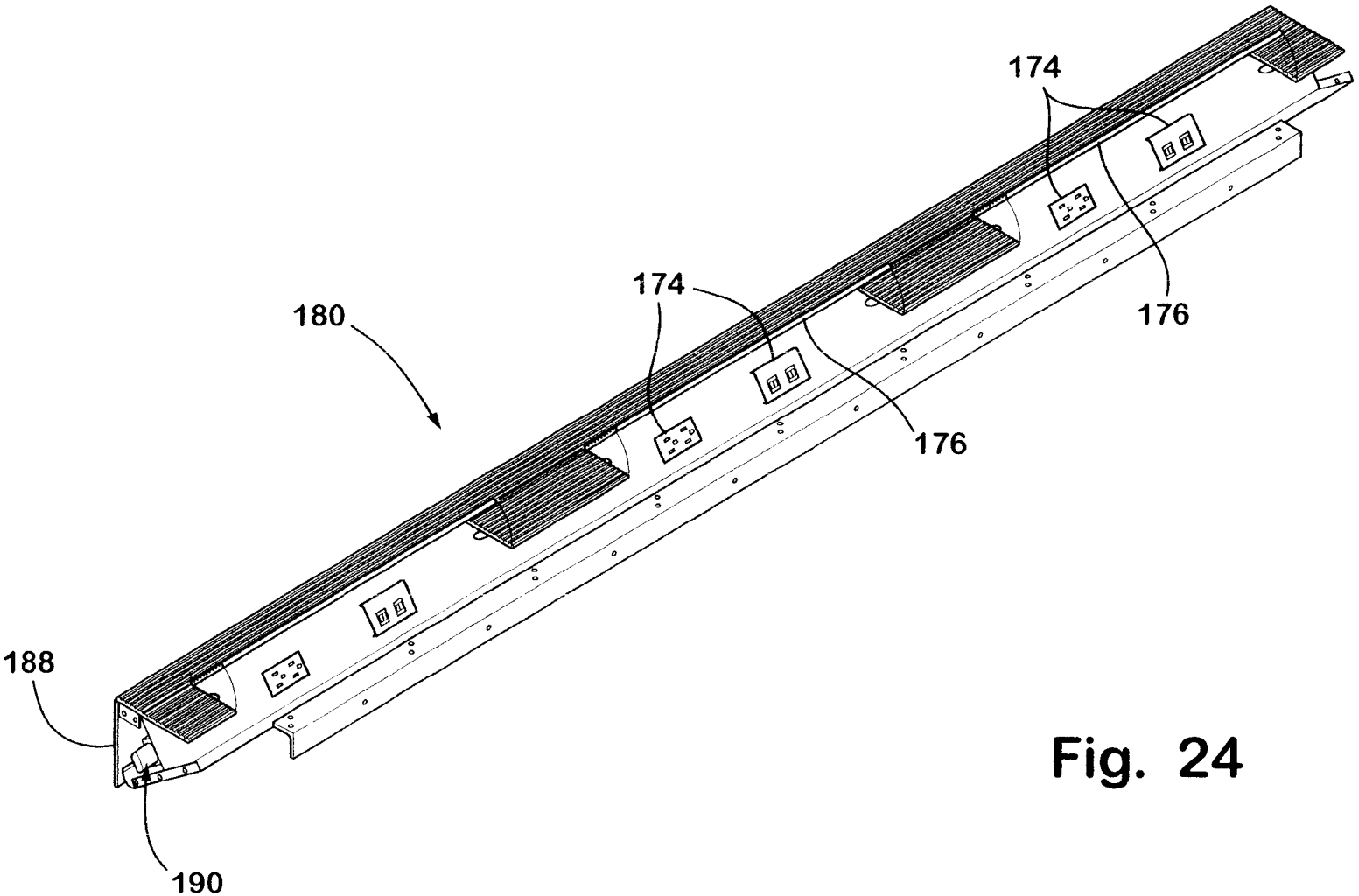
FIG. 24 is a perspective view thereof, without end panels and with the access doors open.

While a wing or top portion 112 or 114, of the table 100 may be supported entirely from the pedestal 102 by an articulating arm or other structures, for example, the preferred embodiment shown uses a wing support sub-frame 150 that is pivotally connected with one of the end pedestal panels 122 and extends to a terminal end (FIGS. 1–5, 7, 8, and 22). A floor standing support leg 152 extends generally downward near the terminal end of the wing frame 150. The wing frame 150 may have a ladder frame construction, using about 1.5 inch (38 mm) deep and 1 inch (25 mm) wide rectangular steel tubing members. The wing frame 150 tapers to a pivot sleeve 154 at one end, that pivotally connects the wing frame with the selected one of the two end pedestal panels 122 (FIGS. 8 and 22).

Accordingly, the end pedestal panel 122 has a cooperating pivot post 156 extending generally upward at a top end of the leg (FIG. 22). For aesthetic reasons to match with the end pedestal panel legs 130, the pivot sleeve 154 may be a tubular right circular cylinder member having an about 1.75 (44 mm) outer diameter, an about 1.5 inch (38 mm) inner diameter, and a length of about 3 inches (76 mm). Thus, the pivot post 156 is an about 1.5 inch (38 mm) diameter member that extends about ¾ inch (19 mm) upward beyond the pivot sleeve 154. The end of the pivot post 156 is provided with an external screw thread that receives a corresponding flanged cap 158 that has corresponding internal screw threads. The wing frame 150 is assembled with the selected end pedestal panel leg 130 by sliding the pivot sleeve 154 over the pivot post 156 to rest upon a shoulder 160 of the leg. The flanged cap 158 is screwed onto the end of the pivot post 156 and holds the pivot sleeve 154 on the pivot post.

In an alternative construction, wear bushings (not shown) may be interposed between the pivot sleeve 154 and the pivot post 156. Although bushings have not been found to be necessary, such bushings may include a washer member under the pivot sleeve 154 and upon the leg shoulder 160 and a tubular member between the pivot sleeve and the pivot post 156, for example. These two bushings may also be combined into a singular T-shaped, flanged, or shouldered bushing, for example.

A power point or services connection channel 170 (FIGS. 1–3, 6–8, 20, 21, 23–25) may be interposed between one or each of the table wings 112 and 114 and the spine 120. While the channel 170 may be fixed relative to the spine 120, the channel is more preferably fixed relative to its respective wing 112 or 114. The channel 170 is more preferably fixed relative to the table wing 112 or 114 to more conveniently move with the wing and the user, rather than having a user accommodate relative movement of the channel by fixing it to the spine 120. The channel 170 provides convenient routing of various conduits 172, including, and not limited to power, communication, fluid, and pneumatic, as well as providing terminal or connection points 174 along the channel to each or selective ones of the provided conduits.

The channel 170 may be constructed of any suitable material by any method appropriate to the material selected. As shown, the channel 170 is an assembly of a number of extruded aluminum members, for example, that assemble into the channel 170. Further, while the channel 170 may be provided with various service and user access configurations, the channel shown is provided with an array of hinged user access doors 176.

Figure 20:
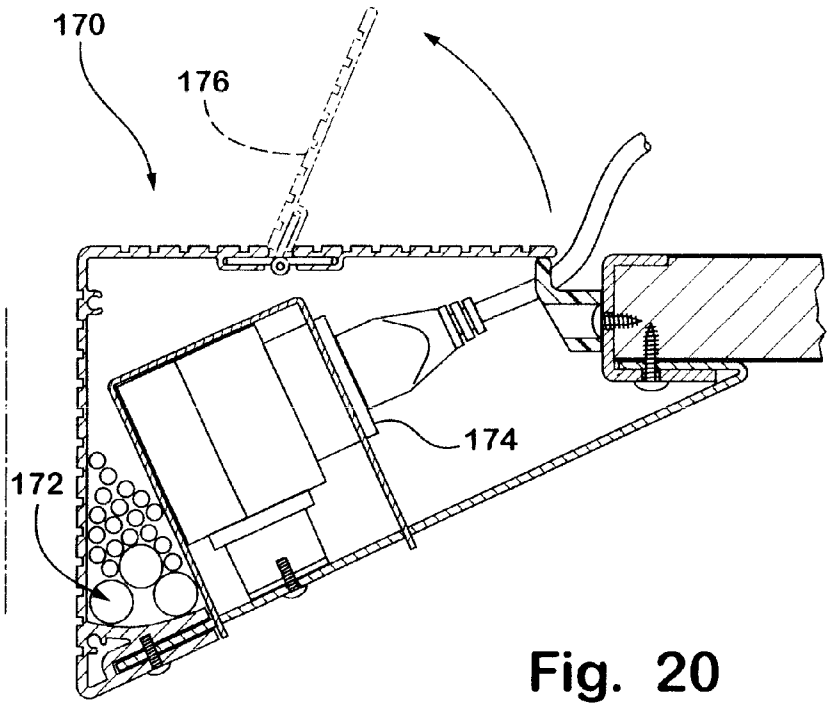
FIG. 20 is an enlarged cross-sectional view of a conduit channel of the table, taken along line XX—XX of FIG. 19 and showing a fragmentary portion of the table wing.
Figure 19:
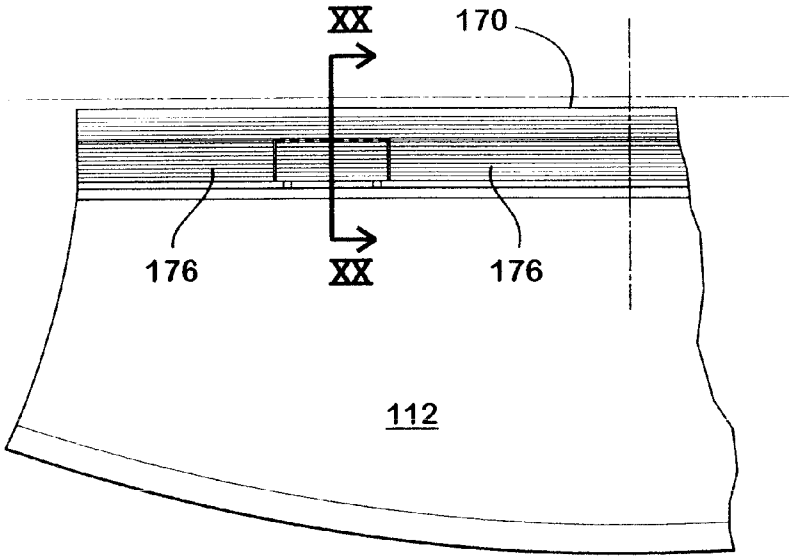
FIG. 19 is a fragmentary top plan view of one end of a table wing of the articulating table, the other end being a mirror image thereof.
Figure 21:
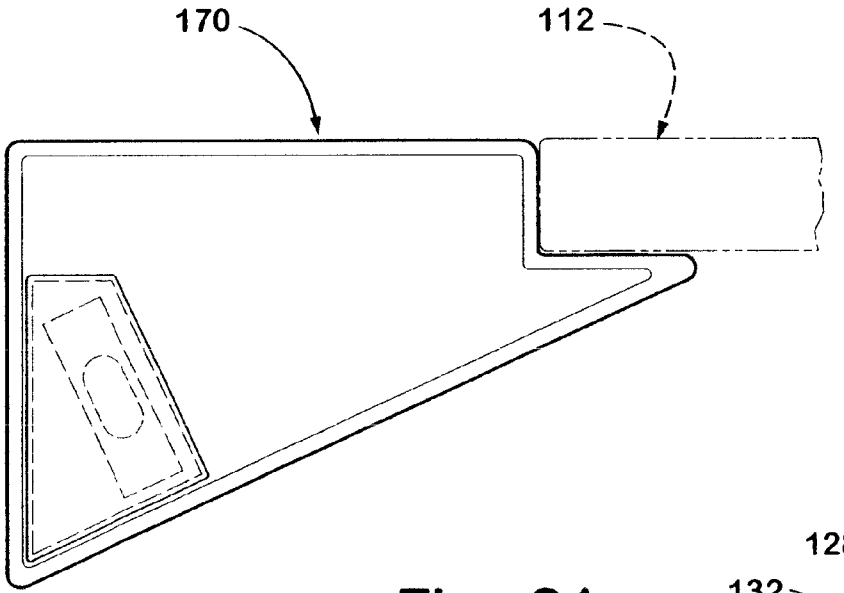
FIG. 21 is an enlarged end elevational view thereof, showing a fragmentary portion of the table wing in phantom.

As shown in the cross sections of drawing FIGS. 8 and 20, the channel 170 may be generally configured as a hollow truncated triangular member having an array of hinged user access doors 176. This configuration has substantially permanent sidewalls and may be said to anticipate a relatively stagnant installation of conduits 172. An alternative channel 180 is shown in drawing FIGS. 23 and 24 which includes a movable installation panel 188 in anticipation of more temporary installation of conduits with greater accessibility, for example. The channel 180 is also provided with a conduit tray or chase 190 for laying-in or routing of conduits.

Figure 25:
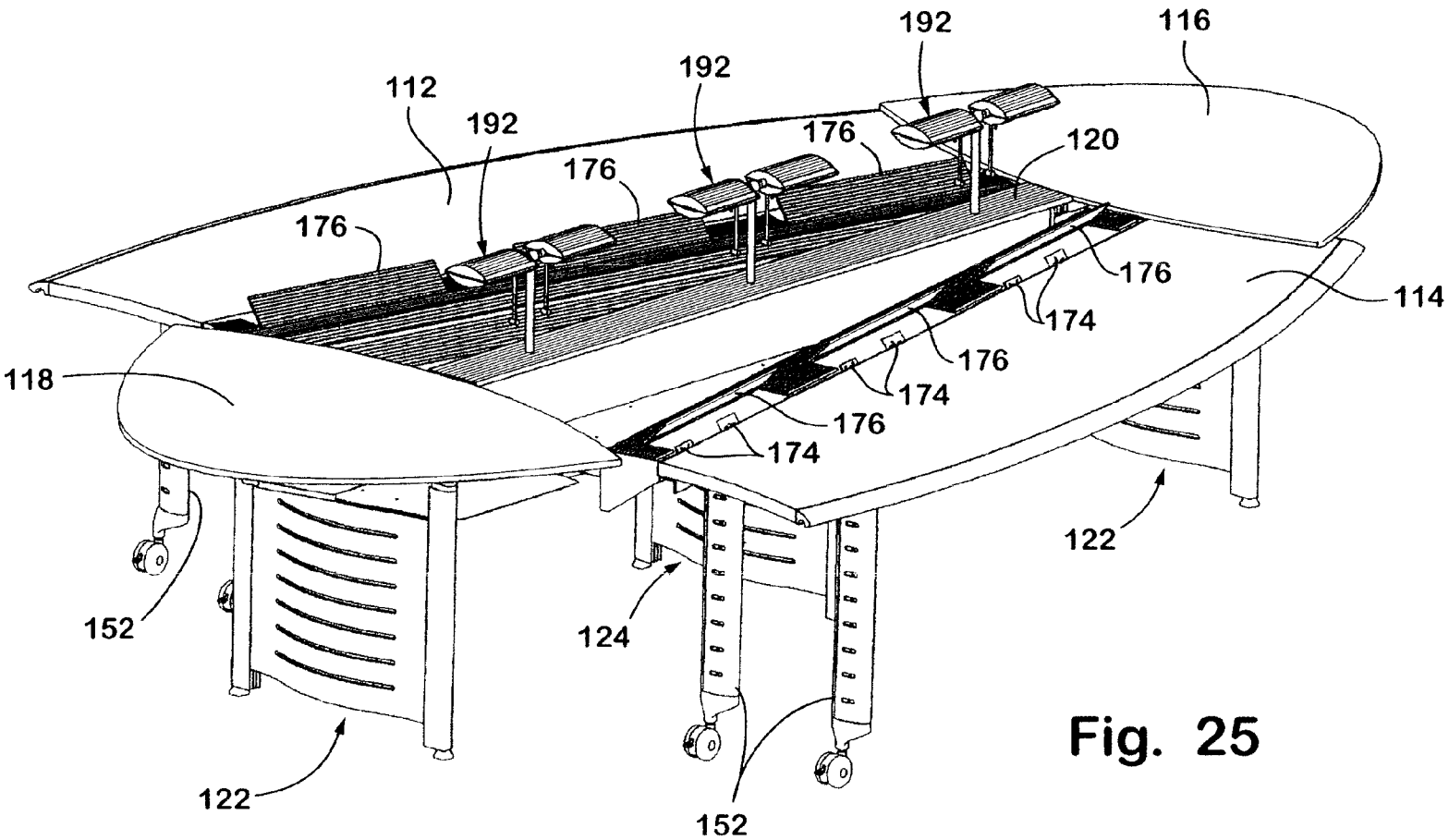
FIG. 25 is the view of FIG. 2 showing one of various optional table mounted lighting arrangements.

In addition to the connection and utility features provided by the conduit channel 170 or 180, optional lighting 192 may be provided along the spine 120 as shown in drawing FIG. 25. Optional lighting may also be provided along the channel 170 or 180.

It will be understood by one having ordinary skill in the art and by those who practice the invention, that various modifications and improvements may be made without departing from the spirit of the disclosed concept. Various relational terms, including left, right, front, back, top, and bottom, for example, are used in the detailed description of the invention and in the claims only to convey relative positioning of various elements of the claimed invention. The scope of protection afforded is to be determined by the claims and by the breadth of interpretation allowed by law.

We claim:

1. An articulating table comprising:

a pedestal;

a table top, the table top having first and second top portions forming opposite sides of the table top, the first and second top portions being operatively connected at one end with the pedestal;

a pivot interposed between the pedestal and at least the first top portion, whereby the first top portion pivots horizontally between open and closed positions relative to the second top portion, the first and second top portions being substantially juxtaposed in the closed position, the first and second top portions being separated in a general V-shape in the open position.

2. The articulating table defined in claim 1 further including a spine connected with the pedestal and extending generally between the first and second top portions.

3. The articulating table defined in claim 2 further including a conduit that extends through at least a portion of the spine, to a terminal end, and including a connector at the terminal end, the conduit and connector providing a connection at the spine, the connection being selected from the group consisting of electrical, optical, pneumatic, and hydraulic connections.

4. The articulating table defined in claim 1 further including a conduit that extends to a terminal end, and including a connector at the terminal end, the conduit and connector providing a connection on the articulating table, the connection being selected from the group consisting of electrical, optical, pneumatic, and hydraulic connections.

5. The articulating table defined in claim 4 further including a conduit that extends to a terminal end, and including a connector at the terminal end, the connector being attached to at least one of the first and second top portions, the conduit and connector providing a connection, the connection being selected from the group consisting of electrical, optical, pneumatic, and hydraulic connections.

6. The articulating table defined in claim 1, wherein the pedestal is a first pedestal and the articulating table further includes a second pedestal connected with the first pedestal.

7. The articulating table defined in claim 6, wherein the second pedestal further includes a second table top.

8. An articulating table comprising:

a pedestal;

first and second swing frames having proximal and distal ends, the proximal ends of the swing frames being adjacent each other and being connected with the pedestal for pivotal movement of the swing frames in a generally horizontal plane;

a table top, the table top having first and second elongated top portions, the first top portion being connected with the first swing frame and the second top portion being connected with the second swing frame, such that the first and second top portions swing between open and closed positions relative to one another and to the pedestal when the swing frames are pivoted outwardly and inwardly with respect to each other, the top portions being substantially juxtaposed side by side when in their closed position and being separated in a V-shape when in their open position.

9. The articulating table defined in claim 8 further including a spine connected with the pedestal and extending generally between the first and second top portions.

10. The articulating table defined in claim 9 further including a conduit that extends through at least a portion of the spine, to a terminal end, and including a connector at the terminal end, the conduit and connector providing a connection at the spine, the connection being selected from the group consisting of electrical, optical, pneumatic, and hydraulic connections.

11. The articulating table defined in claim 8 further including a conduit that extends to a terminal end, and including a connector at the terminal end, the conduit and connector providing a the articulating table, the connection being selected from the group consisting of electrical, pneumatic, and hydraulic connections.

12. The articulating table defined in claim 11 further including a channel for supporting conduit attached to at an inner side of at least one of the first and second top portions, the connector being positioned in the channel and being accessible from an outer side of the table.

13. The articulating table defined in claim 1 wherein the pedestal comprises at least two floor engaging supports spaced apart along a longitudinal direction of the table, with one support being positioned adjacent each end of the table, the top portions extending between the supports and having proximal ends attached adjacent each other to a support, with at least one of the attachments being pivotal by means of the pivot.

14. The articulating table defined in claim 13 wherein each support extends in a lateral direction of the table, with the support at the proximal end including a pair of laterally spaced pivot posts extending upwardly therefrom, the proximal ends of the top portions including sleeves that fit over the posts for pivotal movement thereon, the pivot posts and sleeves comprising the pivots interconnecting the top portions and the pedestal.

15. The articulating table defined in claim 14 wherein an end table top is mounted on the support at the proximal end above the level of the top portions.

16. The articulating table defined in claim 1 wherein conduit channels are positioned at opposed inner sides of the top portions so as to move inwardly and outwardly with the top portions as they pivot relative to one another between the open and closed positions, the conduit channels including one or more of power and communication user terminals at one or more seating locations along outer sides of the table top, with one or more of power and communications wiring extending along the conduit channels to the user terminals, the terminals being easily accessible from the seating positions regardless whether the top portions are in their open or closed positions.

17. The articulating table defined in claim 1 wherein an end table top is mounted on the pedestal at at least one end of the table, the end table top being constructed and positioned such that the end table top does not obstruct movement of the top portions between the open and closed positions.

18. The articulating table defined in claim 17 wherein the table includes end table tops at both ends of the table.

19. The articulating table defined in claim 1 wherein the table top portions are mounted on elongated support frames pivotally attached to the pedestal at inner ends and attached to ground engaging supports at positions spaced outwardly from the inner ends.

20. The articulating table defined in claim 1 wherein at least the proximal ends of the top sections attached to the pedestal are supported by the pedestal.

21. The articulating table defined in claim 20 wherein distal ends of the top portions opposite the proximal portions are supported by movable floor engaging supports that permit inward and outward relative pivotal movement of the distal ends of the top portions between the open and closed positions.

22. An articulating table comprising:

a pedestal;

an elongated table top having outer sides and proximal and distal ends, the table top including first and second top portions, each top portion forming a side of the table, the top portions having opposed inner sides; and mounting means for attaching the proximal ends of the top portions to the pedestal for horizontal angular movement of the top portions with respect to each other between a closed position, wherein the top portions are substantially parallel, and an open position, wherein the top portions are oriented in a generally V-shaped configuration, with the distal ends of the top portions being separated by a greater distance than the proximal ends.

23. The articulating table defined in claim 22 wherein the pedestal extends between the ends of the table and includes support members at the ends of the table, the table including a spine mounted on the support members and extending along the table between the inner sides of the top portions, the spine supporting lighting fixtures and having a conduit for wiring therein.

24. The articulating table defined in claim 22 wherein the pedestal supports the proximal ends of the top portions, the distal ends of the top portions being supported by an independent support that is mounted in a supporting position below each top portion and is movable therewith.

25. The articulating table defined in claim 22 wherein a conduit channel is mounted at the inner side of at least one of the top portions, the channel having a wire receptacle below the level of the table top, the channel having a connector for power or communications wiring or both at one or more user locations along the table, the channels and connectors moving inwardly and outwardly along with the top portions so that the ease of user access is maintained when the top portions are moved to their open position.

* * * * *

UNITED STATES PATENT AND TRADEMARK OFFICE

CERTIFICATE OF CORRECTION

PATENT NO. : 6,588,346 B1
DATED : July 8, 2003
INVENTOR(S) : Robert J. Bockheim et al.

It is certified that error appears in the above-identified patent and that said Letters Patent is hereby corrected as shown below:

Column 6,
Line 57, insert -- connection on -- after “a”
Line 61, delete “to” after “attached”

Column 7,
Line 22, delete “of” after “more”
Line 32, delete “top” after “table”

Column 8,
Line 40, insert -- the -- before “connectors”
Line 42, “position” should be -- positions --

Signed and Sealed this

Twentieth Day of April, 2004

JON W. DUDAS
*Acting Director of the United States Patent and Trademark Office*